US007467771B2

(12) United States Patent
McKinney

(10) Patent No.: US 7,467,771 B2
(45) Date of Patent: Dec. 23, 2008

(54) SHEETING GOODS INSTALLATION SUPPORT

(76) Inventor: Gene Curtis McKinney, 11881 Coloriver Rd., Manassas, VA (US) 20112

( * ) Notice: Subject to any disclaimer, the term of this patent is extended or adjusted under 35 U.S.C. 154(b) by 186 days.

(21) Appl. No.: 11/268,596

(22) Filed: Nov. 8, 2005

(65) Prior Publication Data

US 2007/0102614 A1 May 10, 2007

(51) Int. Cl.
*E04G 3/00* (2006.01)

(52) U.S. Cl. ..... 248/282.1; 248/289.11

(58) Field of Classification Search ..... 248/228.1, 248/274.1, 282.1, 289.11, 276.1, 288.11; 16/86.1, 86.2, 389, 390; 403/72, 73, 119; 52/712, 714

See application file for complete search history.

(56) References Cited

U.S. PATENT DOCUMENTS 503,135 A * 8/1893 Groves ..... 403/73
4,402,481 A * 9/1983 Sasaki ..... 248/282.1
4,447,031 A * 5/1984 Souder et al. ..... 248/281.11
4,568,052 A * 2/1986 Solomon et al. ..... 248/281.11
4,590,695 A * 5/1986 McGillivray ..... 38/102.2
4,836,486 A * 6/1989 Vossoughi et al. ..... 248/281.11
6,293,058 B1 9/2001 Sink
6,508,448 B1 1/2003 Stewart

* cited by examiner

*Primary Examiner*—A. Joseph Wujciak, III
(74) *Attorney, Agent, or Firm*—William D. Titcomb

(57) ABSTRACT

The present invention relates to a sheeting goods installation support. The present invention includes a system and techniques using a sheeting goods installation support for both overhead ceiling and vertical wall applications. A solo worker can install sheeting goods using the inventive sheeting goods installation support system. The inventive sheeting goods installation support can be operated by attaching an end articulation bracket to a support member with the end articulation bracket connected to a first elongated beam and placing sheeting goods upon the first elongated beam. Next, a worker can position the sheeting goods proximate to the end articulation bracket and temporarily secure the sheeting goods with a second elongated beam. Next, a worker can adjust the sheeting goods in a final position proximate to the support member, secure the sheeting goods to the support member, and remove the sheeting goods installation support from the support member.

12 Claims, 3 Drawing Sheets

SHEETING GOODS INSTALLATION SUPPORT

BACKGROUND OF THE INVENTION

1. Field of Invention

This invention relates to sheeting goods installation equipment and particularly to the installation of sheeting goods requiring overhead support.

2. Description of Related Art

Conventional sheeting goods are commonly used in the construction trade for fabrication of walls, floors, and especially ceilings and other overhead applications. The widespread use of sheeting goods allows for large panels or sheets to be quickly fastened into place, saving the otherwise more labor-intensive process of fastening smaller planking and/or other more repetitious members into a matrix. The use of sheeting goods is especially useful for the most cumbersome of installations; those where space constraints further complicate the fabrication process.

In order for sheeting goods to be most useful in the construction trade, the sheeting must be handled in a fashion that positions the sheeting material in close proximity to the location where they are to be fastened. With larger sheeting products, including, for example sheet rock with dimensions typically four (4.0) by eight (8.0) feet or four (4.0) by twelve (12.0) feet (height and length) and in widths of one-quarter (¼) to one (1.0) inches; handling techniques can be problematic.

The larger sheeting products must be transported from a delivery drop location to the general location for installation. Once at the general location for installation, the individual sheets may be moved more closely to their final placement for installation. However, before the individual sheets are ready for their final installation, with any of a number of conventional fasteners, the sheets must be carefully moved into position where the edges of one sheet meet the edges of another sheet. Furthermore, after the sheets have been aligned in reference to the surrounding or connecting sheets, or other edging constraints, the sheets must be held in close proximity to an underneath, supporting framework, and in turn fastened into this supporting framework.

One problem with the conventional sheeting goods is the difficulty an installer may face when they have to hold a sheet in close proximity to the supporting framework before the sheet can be fastened onto this supporting framework. Accordingly, many installations of sheeting goods require the installers to work in teams with often several members working together on a given team. In smaller installation situations, where for example, a small room or hallway needs sheeting goods, space may not accommodate more than one worker.

Further, with the conventional sheeting goods systems their support structures are constructed with a combination of intersecting legs. These intersecting leg members are designed to maintain a large, broad expansive footprint to stabilize the apparatus during the operation with a top-heavy load. Even with the most space-efficient intersecting support, an inverted T-member, space constraints can prevent freedom of movement. Accordingly, in situations where the floor space does not allow for an expansive footprint the use of such conventional sheeting goods systems is very limited.

Further, another aspect of conventional sheeting goods installation requires lifting or hoisting the sheeting goods often followed by flipping over the individual sheets before alignment and attachment. In addition to the handling-intensive process that the worker must maintain, oftentimes in overhead installations lack of space or when working at heights well above a typical worker's reach, a final flip or another form of manipulation is logistically impossible.

Further, when an installation of sheeting goods requires overhead or ceiling installation, the team member must work above his head for a protracted period of time. Such reaching and manipulation of the sheeting goods above the team member's head is very exhausting work. An installation project that continues in a repetitive and exhausting nature of the stretch, reach and hold technique, or any other conventional technique, can lead to a work place injury.

Further, another aspect of conventional sheeting goods installation requires lifting or hoisting the sheeting goods often followed by flipping over the individual sheets before alignment and attachment.

Further, with the increasing costs associated with labor, more efficient use of the workforce and team members would be desirable in any construction trade. Obviously, the best case for efficiency would employ only one team member for an installation.

Accordingly, it is an object of the present invention to provide a device to assist in manipulation and placement of sheeting goods.

It is another object of the present invention to provide a device where an individual, or single team member, may manipulate and install a sheeting goods.

It is further another object of the present invention to provide a device that can assist in the manipulation, placement, and installation of sheeting goods in an overhead location.

SUMMARY OF THE INVENTION

The foregoing problems are solved and the foregoing objects are achieved in accordance With one illustrative embodiment of the invention in which a Sheeting Goods Installation Support is utilized to assist in manipulation and proper placement of sheeting goods, provide efficient deployment of labor, and assist in the manipulation, placement, and installation of sheeting goods in an overhead location. A sheeting goods installation support system, including: attaching an end articulation bracket to a support member with the end articulation bracket being connected to a first elongated beam; placing sheeting goods upon the first elongated beam anterior to the end articulation bracket; lifting the sheeting goods proximate to the end articulation bracket and temporarily securing the sheeting goods with a second elongated beam; adjusting the sheeting goods in a final position proximate to the support member; securing permanently the sheeting goods to the support member; and removing the sheeting goods installation support from the support member.

In accordance with the principles of the invention, a sheeting goods installation support is created which can be easily be used for the manipulation and installation of sheeting goods. The low weight sheeting goods installation support can in several applications, be easily controlled by a single worker. In addition the articulation of the sheeting goods support, which provides an adjustable pivot point, provides an extension of an individual's reach and ease of placement of sheeting goods in an overhead application.

DETAILED DESCRIPTION OF THE PREFERRED EMBODIMENT

Figure 1:
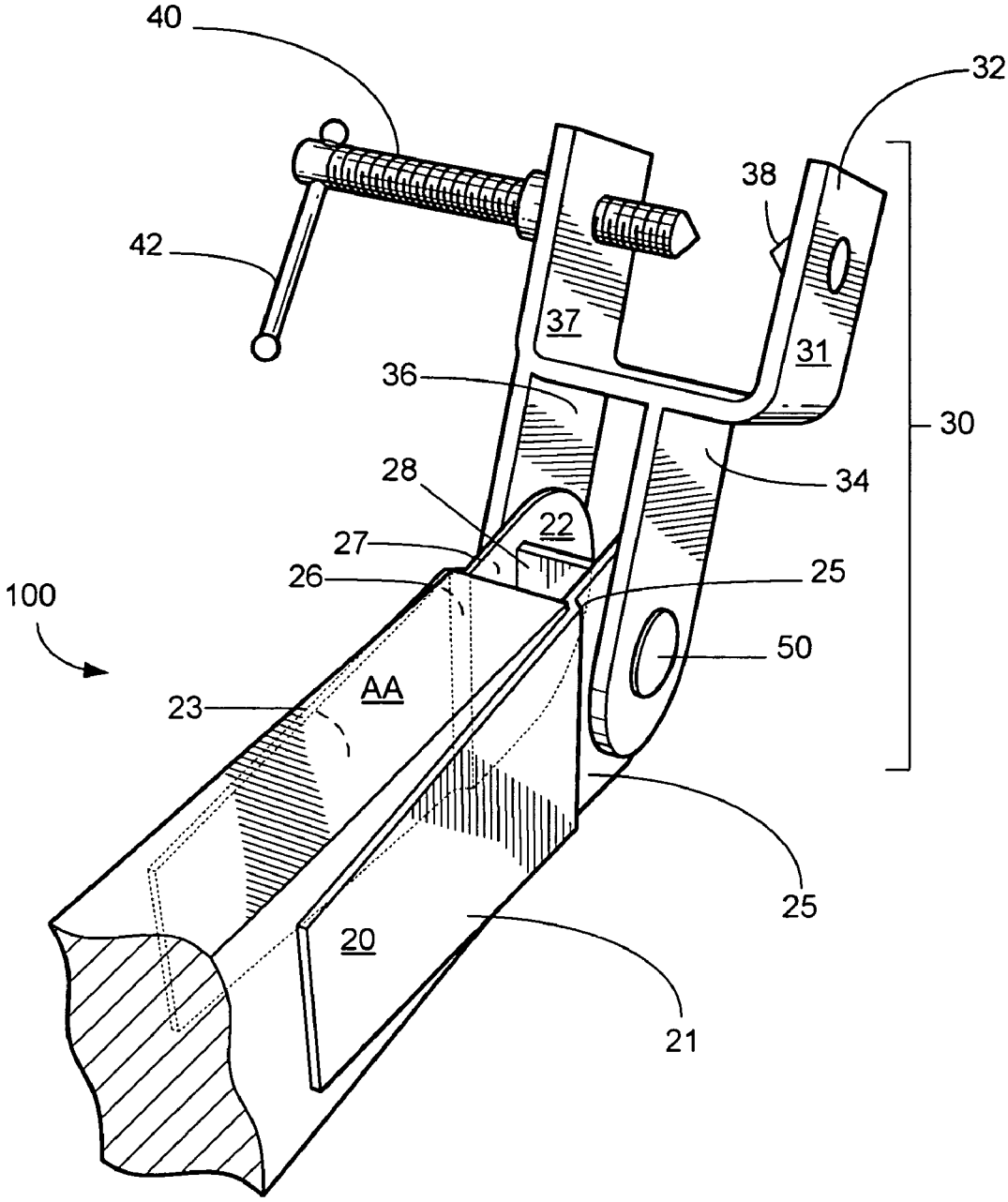
FIG. 1 is a perspective of one end articulation bracket of the inventive sheeting goods installation support.

FIG. 1 is a perspective view of one end articulation bracket 100 for sheeting goods installation support 1 (discussed below) constructed in accordance with the principles of the present invention. The primary material used for fabrication of the sheeting goods installation support 1 can be, for example a type of metal. However, it should be understood that metallic, or not, any rigid material of sufficient structural and supportive character may be used.

The end articulation bracket 100 comprises two anchor plate assemblies 20 and 22 which together support a threaded clamp assembly 30. The threaded clamp assembly 30 pivots upon the anchor plate assemblies 20 and 22, while held in place by a fastener bolt 50. Furthermore the anchor plate assemblies 20 and 22 comprise a twin wing configuration to receive an elongated beam AA. The elongated beam may be, for example, a wooden 2×4 or any other beam or bar of a linear length which is suited for installation of the sheeting goods. A square-edged, or otherwise angled beam is used as an example, and for illustration, however the invention is not limited to the use of a beam or bar with these characteristics. Further, the beam or bar, may be, for example cut for a specific application where the linear reach of the support beam or bar must accommodate the application, or a worker's reach, or a combination of both the application and the worker's reach.

The elongated beam AA is received between the two wings of the anchor plate assemblies 20 and 22, and may be fastened in place with adhesive, or some other mechanical fastener. The two plates are designed to receive an elongated beam AA and rigidly hold the elongated beam AA between the two plates, and provide an opening for bolt 50. In addition, each of the two wings are designed with an angled, offset seam, 24 and 26 respectively, which creates a fitted, shrouded connection for receiving one leading end of the elongated beam AA.

In one embodiment, each of the twin wings are comprised of two separate plates 21, 25 and 23, 27. The two separate plates are joined together to form an offset junction 24 and 26. However, a single plate may be used to form the twin wings wherein each single plate would be formed from a unitary piece of stock material and contain an offset seam. The anchor plate assembly 20 with the twin wing configuration is further designed to receive an elongated beam between the twin wings, wherein the leading end of the elongated beam will be inserted in between the twin wings up to the offset junction 24 and 26. The twin wing assembly is further supported by support member 28. The support member 28 is fixed in place by a conventional bonding process. Support member 28 is placed between and perpendicular to plates 25 and 27. The support member 28 acts to brace plates 25 and 27, to prevent over compression of the plates 25 and 27 which could result in their misalignment.

The plates 25 and 27 support the threaded clamp assembly 30 which is pivotally joined with a fastener bolt 50 to clamp supports 34 and 36. The clamp supports 34 and 36 are perpendicularly connected to and support the clamp jaw 32. The supports 34 and 36 are fixed in place by a conventional bonding process. The clamp jaw 32 is formed from a U-shaped member and the clamp supports are connected to the base portion of the U-shaped member (as shown in FIG. 1).

The two side sections 31 and 37 of the clamp jaw 32 are formed to be parallel to each other in order to facilitate holding an object or material within the clamp jaw 32. Further, one side section is formed with an inward, fixed, protruding and pointed "tooth ", while the other side section is formed to receive a threaded bolt 40 that is directly opposite said tooth. The tooth 38 may be, for example formed to point for additional bite when the threaded bolt 40 compresses against a work piece (not shown). Furthermore the leading end of the threaded bolt 40 may, for example be formed to include a point. However, it should be understood that the neither the threaded bolt 40 nor the tooth 38's pointed character is intended to limit the scope of the invention. Rather, the character of the threaded bolt 40 and the tooth 38 are used for illustration and do not act to limit the scope of the invention to any single characterization or embodiment.

A hole (not shown), is cut through the threaded bolt 40, and receives a crossbar 42. The crossbar 42 provides additional leverage, and a handle for ease of manipulation of the threaded bolt 40. When the threaded bolt is wound into the clamp jaw 32, the leading head of the threaded bolt 40 will compress any work piece object or material against the directly opposing protruding tooth 38.

Figure 2:
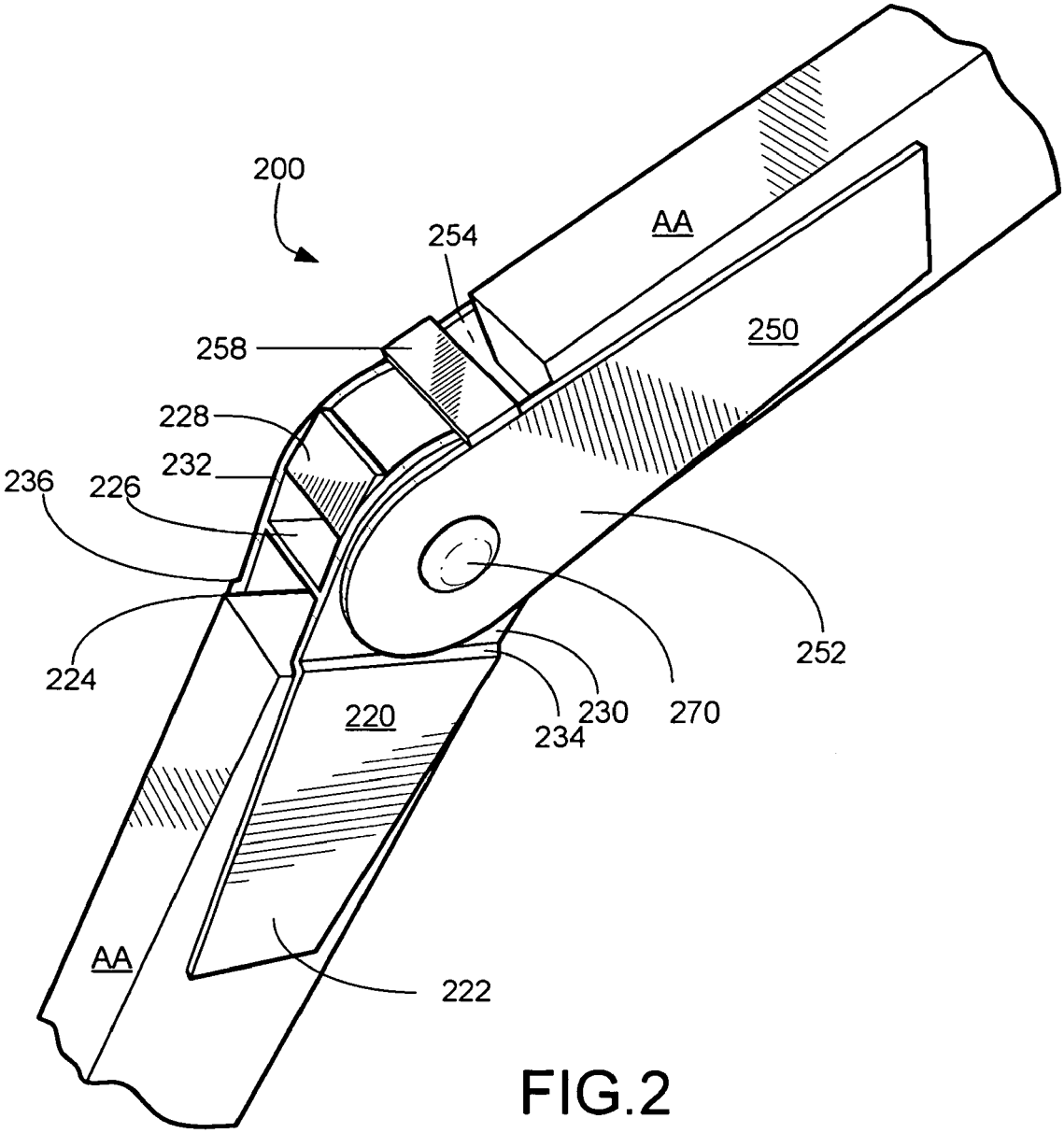
FIG. 2 is a perspective of the central articulation bracket of the inventive sheeting goods installation support.

FIG. 2 is a perspective view of the central articulation bracket 200 of sheeting goods installation support 1 (discussed below) constructed in accordance with the principles of the present invention. The articulation bracket 200 is comprised of two sets of hinged wings; the first set 220 is further comprised of a pair of first plates 222 and 224 connected to second plates 230, and 232, respectively. The respective intersection of the individual plate pairs is indicated as 234, and 236. The respective intersections 234 and 236 are formed at an offset junction. Additionally, as described above, the intersection or offset junctions 234, and 236 creates a fitted, shrouded connection for receiving one leading end of the elongated beam AA.

In one embodiment, each half of one twin wing 220, is comprised of two separate plates 222, 230 and 224, 232, respectively. The two separate plates are joined together to form an offset junction 234 and 236. However, a single plate may be used to form the twin wings wherein each single plate is formed from a unitary piece of stock material. Only one twin wing 220 will have the offset junction formation.

The hinged wings are formed with the one wing pair 220 including the offset junctions 234 and 236, formed and spaced to receive the second twin wing 250 and allow articulation of the hinged wing. The second twin wing 250 is pivotally connected to the second twin wing 220 with a bolt 270. The bolt 270 will extend through the central articulation bracket, secured by a threaded nut (not shown) or another conventional fastener. The bolt 270 will allow an articulated movement of the central articulation bracket in both a clockwise and counterclockwise direction. The 30 bolt 270 may be, for example, tightened to prevent movement of the central articulation bracket.

Wing pair 220 further comprises internal structures, including a strut 226 and a stop 228. These structures are fixed in place by a conventional bonding process. The strut 226 is positioned parallel to the offset junctions 234 and 236, and perpendicular to the internal faces of the plate pair 234 and 236. The strut 226 will support the wing pair 220, and also prevent any over compression of the wing pair 220 by the bolt 270 and nut. The stop 228 is positioned along the side edge of the wing pair 220, and fastened perpendicular to the edges of plates 230 and 232. The stop 228 will support the wing pair 220 and assist in the prevention of over compression, and also prevent over-articulation of the central articulation bracket 200 (as discussed below).

Wing pair 250 further comprises internal structures, including a stop 258. The stop 258 is held in place by a conventional bonding process. The stop 258 is positioned along the side edge of the wing pair 250, and is fastened perpendicular to the edges of plates 252 and 254. The stop 258 will support the wing pair 250 and assist in the prevention of over compression. The primary function of the stop 258 is to come in contact with stop 228 during operation of the central articulation bracket 200. When the central articulation bracket 200 is opened to approximately 180 degrees, the stop 228 on wing pair 220 contacts the stop 258 on wing pair 250 and prevents any further articulation movement.

The ability of the inventive sheeting goods installation support 1 to maintain an essentially linear articulation, when the stop 228 comes in contact with stop 258, allows a worker the option to slide a sheeting goods section up the elongated beam sections AA to a position in the proximity of their final position. Additionally, if the installation position is located below the worker's position, the linear articulation may be used to slide sheeting goods down the elongated beam sections AA. These functions can be employed when a worker is stationed upon scaffolding or superstructure with the given space and mobility constraints.

Figure 3:
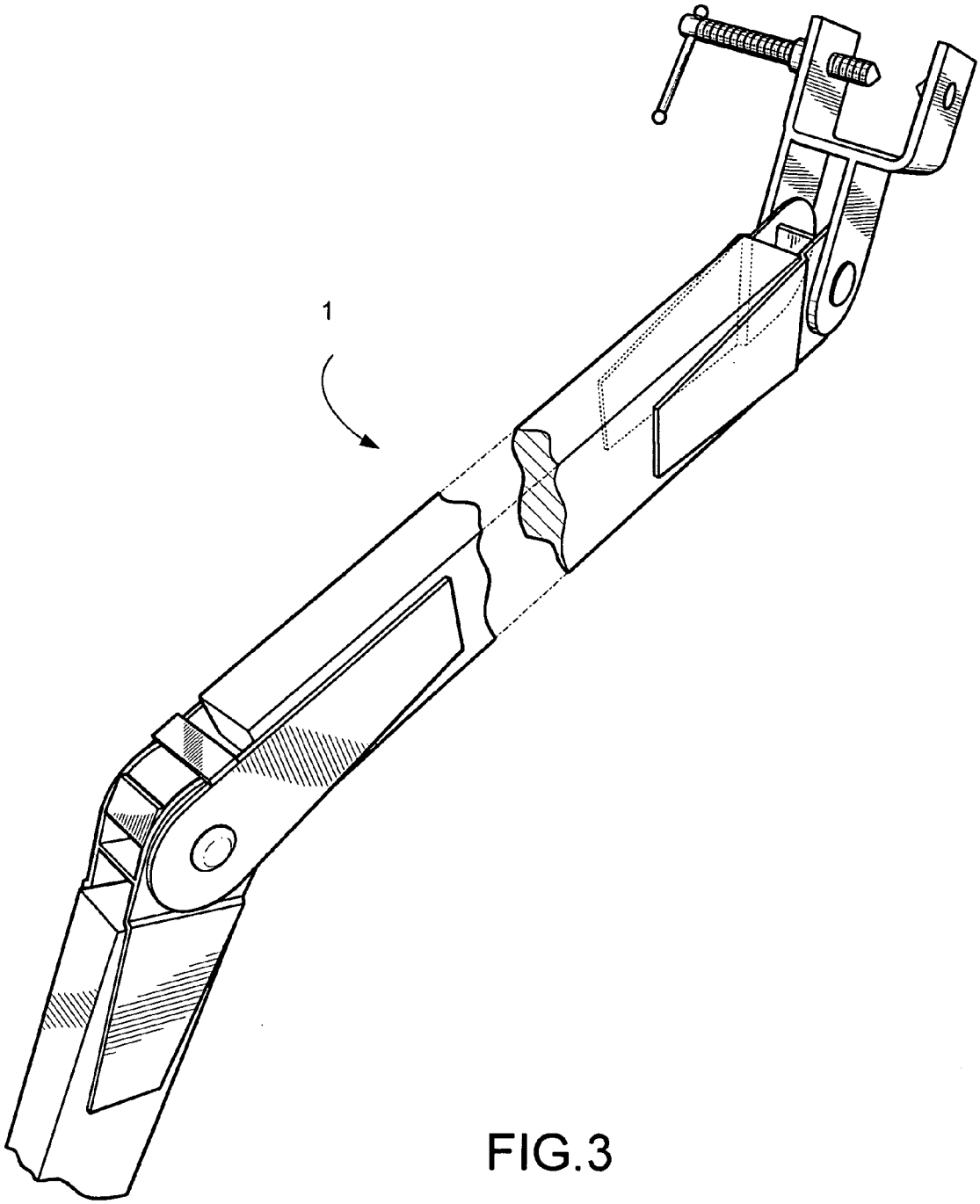
FIG. 3 is a diagram of the relationship of the central articulation bracket and one end articulation bracket of the inventive sheeting goods installation support.

FIG. 3 is a diagram of the relationship of the central articulation bracket 200 and one end articulation bracket 100 of the inventive sheeting goods installation support 1.

As shown in FIGS. 1, 2 and 3, the inventive sheeting goods installation support 1 can be used to attach to beam and allow for leverage during support and installation of sheeting goods. The aforementioned installation support 1 can be useful for vertical and horizontal support and leverage, as well as sheeting goods handling operations which have both horizontal and vertical components. Additionally, using the threaded clamp assembly 30, and the central articulation bracket 200, independently, or in combination, the inventive sheeting goods installation support 1 can be useful when the support and installation process requires a compound angular movement. For example, the sheeting goods installation support 1 can be used for applications requiring movements greater than 180 degrees.

The inventive sheeting goods installation support 1 can be used to hold in place large sheeting goods for ease of installation. One example, when the inventive sheeting goods installation support can be used is an overhead ceiling application. A worker can easily first position the low weight, inventive sheeting goods installation support 1 with the end articulation bracket 100 up towards the ceiling. Next, the worker may locate an exposed ceiling beam, for example a truss support, and secure the threaded clamp assembly 30 to said ceiling beam.

The threaded clamp assembly 30 would be fastened to the exposed ceiling beam by positioning the open-end of the threaded clamp assembly 30 around any exposed section of the ceiling beam, and then securing the clamp assembly 30 to the exposed beam by tightening the threaded bolt 40. The pressure created as the threaded bolt 40 is tightened on one side of the exposed beam causes the tooth 38 to bite into the other side of the exposed beam Care should be exercised when securing the threaded clamp assembly 30 to the exposed beam to not over-extend the threaded bolt 40 into the exposed beam. The depth of penetration would depend both upon the type of material that the exposed beam is made of, and the weight of the sheeting goods for installation.

After the clamp assembly 30 is appropriately secured to the exposed beam, a worker can loosen the fastener bolt 50 which pivotally connects the threaded clamp assembly 30 to the anchor plate assemblies 25 and 27. It is desirable to have the fastener bolt 50 tightened to the point that the bolt begins to exert pressure upon the plate assemblies 25 and 27, but not to the degree that the plate assemblies 25 and 27 fail to pivot easily as the worker manipulates the inventive sheeting goods installation support 1.

Next, a worker can loosen the bolt 270 which pivotally connects the two twin wing assemblies 220 and 250, of the central articulation bracket 200. Again, it is desirable to have the bolt 270 tightened (or loosened) to the point that the bolt begins to exert pressure upon wing assemblies 220 and 250, but not to the degree that the plate assemblies 220 and 250 fall to pivot easily as the worker manipulates the central articulation bracket 200.

After bolts 50 and 270 are tightened or loosened, as needed, a worker can place desired sheeting goods upon the sheeting goods installation support 1. One leading edge of the sheeting goods would be placed next to or in direct contact with the clamp supports 34 and 36. Placing sheeting goods in direct contact or close proximity to clamp supports 34 and 36 can permit the worker to fasten that leading edge of the sheeting goods directly to a structural support of the ceiling. In addition, the elongated beam AA, located between the threaded clamp assembly 30 and the central articulation bracket 200, would further support the span of sheeting goods during placement and installation, for example the fastening of the leading edge of the sheeting goods.

For example, a worker employing the inventive sheeting goods installation support 1 can grasp the trailing section of an elongated beam AA, a wooden 2×4, located below the central articulation support 200, and by raising the beam AA while pivoting the central articulation support 200 approximately 90 degrees, raise the sheeting goods up into a position in close proximity to the structural support of the ceiling. One desirable length for the trailing elongated beam AA can be the approximate distance from the floor to the ceiling of a particular location. With the trailing elongated beam AA measuring approximately the distance from the floor to the ceiling, the sheeting goods installation device can be wedged into place to securely hold sheeting goods near to the ceiling. After positioning the sheeting goods near to the ceiling, a worker can make the final positional adjustments to sheeting goods, and begin to fasten the sheeting goods in the desired location.

Heavy repetitive lifting of the sheeting goods can be reduced with the threaded clamp assembly 30 firmly attached to a strut or brace, the inventive sheeting goods installation support 1 can provide a worker with a sloping wedge to slide heavy sheeting goods section up the elongated beam AA without needing to physically lift the sheeting goods.

Another example employing the inventive sheeting goods installation support 1 can be a worker installing sheeting goods onto, or to form a wall. As before the worker can position the end articulation bracket 100 near the wall studs, or other vertical framing members, and fasten the threaded clamp assembly 30 to a conveniently located wall stud. The worker can adjust bolts 50 and 270, and then place sheeting goods upon the elongated beam AA.

Next, the worker may slide the sheeting goods towards the wall using the elongated beam AA as an inclined ramp to facilitate installation. Once the sheeting goods have been positioned near to the end bracket 100, a worker can lift the elongated beam sections AA as a lever, and move the sheeting goods in close proximity to its desired installation location. Then the worker can lift the elongated beam sections AA completely up until the first elongated beam AA, between the end bracket 100 and the central articulation bracket 200, comes in contact with the sheeting goods.

The inventive sheeting goods support 1 acts as extra "arm" with the first section of the elongated beam AA in direct contact with, and supporting the sheeting goods. With the assistance of the inventive sheeting goods support 1 a worker can easily complete the final positional placement, and fasten the sheeting goods in place.

A design feature of the inventive sheeting goods installation support 1 is that its operation is not solely dependent upon the bolts 50 and 270 being tightened. The primary ability of the installation support 1 is to allow a worker to move either, or both, the end bracket 100, and the central articulation bracket 200, about their respective pivot points, bolts 50 and 270. When the stop 228 and stop 258 come in contact, they will function to hold the installation support 1 in an essentially linear form, regardless of whether the bolts 50 and 270 are tightened to the degree to prevent further articulation.

Alternatively, the inventive sheeting goods installation support 1 can be used by a single worker for support and installation of sheeting goods that would usually require additional workers. The inventive sheeting goods installation support 1 is compact and low weight allowing a single worker to move and operate it easily. For example, after securing the threaded clamp assembly 30 to a beam or post, a solo worker may then place sheeting goods upon the installation support 1 and push the sheeting goods into position. Additionally, the use of more than one sheeting goods installation support 1 can be used for applications requiring long spans of materials. In such applications, a solo worker could initial lift and lock the installation support in place, holding one end of the sheeting goods, and then proceed to a second installation support for use at another location.

While this invention has been described in conjunction with the exemplary embodiments outlined above, it is evident that many alternative, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A sheeting goods installation support system, comprising:

a first elongated beam;

second elongated beam, wherein the first beam and second beam are being pivotally connected by a central articulation bracket;

the central articulation bracket further comprising:

a first set of hinged wings mounted on the first beam;

a second set of hinged wings mounted on the second beam; which interconnect with the first set of hinged wings to form a pivot point through which the central articulation bracket pivotally operates;

a first internal stop associated with the first set of hinged wings;

a second internal stop associated with the second set of hinged wings which cooperates with the first internal stop to prevent the central alticulation bracket from pivotal operation beyond the point wherein the first stop and the second stop engageably cooperate and with the first stop and the second stop in engaged cooperation the first elongated beam and the second elongated beam operate in unison for leverage and manipulation of the installation support system as an essentially linear span; and an end articulation bracket mounted on one of the beams' end opposed from the first and second sets of hinged wings, further comprising:

a threaded clamp assembly.

2. The sheeting goods installation support system of claim 1, wherein the first elongated beam is located between and rigidly connected to the end articulation bracket and the central articulation bracket, and the second elongated beam is rigidly connected to the central articulation bracket.

3. The sheeting goods installation support system of claim 2, wherein the end articulation bracket is pivotally mounted to the first elongated beam, and the first elongated beam is pivotally mounted to the second elongated beam.

4. The sheeting goods installation support system of claim 3, wherein the threaded clamp assembly has a first protrusion and opposing second protrusion.

5. The sheeting goods installation support system of claim 4, wherein the threaded clamp assembly is fastened in place allowing for accommodation of different shapes and orientations of a work piece, while maintaining sufficient force to hold the work piece in place between the first protrusion and the second protrusion.

6. The sheeting goods installation support system of claim 5, wherein the end articulation bracket being pivotally mounted to the first elongated beam, permits the first elongated beam to pivot up towards the end articulation bracket and the threaded clamp assembly to come in contact with and hold the sheeting goods against the work piece.

7. The sheeting goods installation support system of claim 6, wherein the essentially linear span including the first elongated beam and the second elongated beam transfers a sheeting good transversely along the linear span.

8. The sheeting goods installation support system of claim 6, wherein the essentially linear span created by the first elongated beam and the second elongated beam and being operated in unison increase the vertical reach of a user of the sheeting goods support system in proportion to the length of the essentially linear span of the first elongated beam in combination with the second elongated beam.

9. The sheeting goods installation support system of claim 6, wherein the essentially linear span created by the first elongated beam and the second elongated beam and being operated in unison increase the leverage force proportional to the length of the essentially linear span of the first elongated beam in combination with the second elongated beam.

10. The sheeting goods installation support system of claim 6, wherein the first internal stop is positioned along a side portion of the first set of hinged wings to support each half of the hinged wings in a position whereby one half is directly superior to and in parallel to the other half.

11. The sheeting goods installation support system of claim 6, wherein the second internal stop is positioned along a side portion of the second set of hinged wings to support each half of the hinged wings in a position whereby one half is directly superior to and in parallel to the other half.

12. The sheeting goods installation support system of claim 6, wherein the first internal stop and the second internal stop are struts that assist in the prevention of over compression of the central articulation bracket.

* * * * *